US008308624B2

(12) United States Patent
Travers et al.

(10) Patent No.: US 8,308,624 B2
(45) Date of Patent: Nov. 13, 2012

(54) PROCESS FOR MAKING FILTER TOW

(75) Inventors: John Travers, Spondon (GB); Craig Day, South Normanton (GB); Andrew Banks, Mickleover (GB)

(73) Assignee: Celanese Acetate Limited, London (GB)

( * ) Notice: Subject to any disclaimer, the term of this patent is extended or adjusted under 35 U.S.C. 154(b) by 355 days.

(21) Appl. No.: 12/064,467

(22) PCT Filed: Aug. 25, 2006

(86) PCT No.: PCT/GB2006/003179

§ 371 (c)(1),
(2), (4) Date: Jun. 4, 2008

(87) PCT Pub. No.: WO2007/026131

PCT Pub. Date: Mar. 8, 2007

(65) Prior Publication Data

US 2008/0245376 A1 Oct. 9, 2008

(30) Foreign Application Priority Data

Aug. 27, 2005 (GB) ..... 0517551.8

(51) Int. Cl.
*B31C 99/00* (2009.01)
*A24C 5/00* (2006.01)

(52) U.S. Cl. ..... 493/47; 493/39; 131/280; 131/342; 131/364

(58) Field of Classification Search ..... 493/39, 493/42, 45, 47, 49, 50; 131/280, 276, 364, 131/352, 342, 345
See application file for complete search history.

(56) References Cited

U.S. PATENT DOCUMENTS 2,953,838 A 9/1960 Crawford et al.
(Continued)

FOREIGN PATENT DOCUMENTS

CN 1356072 A 7/2002
(Continued)

OTHER PUBLICATIONS

"Manufacture of Acetate Fiber," GuangDong, Chemical Fibre (Jun. 1994), (Issue. 2), (p. 27-34).

*Primary Examiner* — Hemant M Desai
(74) *Attorney, Agent, or Firm* — Hammer & Associates, P.C.

(57) ABSTRACT

A method of preparing a crimped tow of cellulose acetate filaments comprising the steps of: a) providing cellulose acetate dope b) forming filaments (23) from the dope c) applying at least one additive to the filaments d) crimping the filaments to form a crimped tow wherein the at least one additive is capable of removing a component from cigarette smoke. Preferably, the component is a Hoffmann analyte. The additive may comprise a solution, liquid, emulsion or particulate material or combinations thereof. Preferably, the additive comprises an acidic compound or an alkaline compound. The additive may comprise malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate and carboxylated acrylate, carbon, silica, zeolite, clay, alumina, metal, molecular sieves or an ion exchange resin. The product tow can be processed on standard equipment to make efficient filter rods from which cigarette filter tips can be made which give significantly increased and selective retention of key smoke constituents.

47 Claims, 11 Drawing Sheets

U.S. PATENT DOCUMENTS

| | | | | | |
|---|---|---|---|---|---|
| 3,008,472 | A | * | 11/1961 | Touey | 131/342 |
| 3,021,242 | A | * | 2/1962 | Touey | 156/180 |
| 3,038,780 | A | * | 6/1962 | Kiefer et al. | 264/207 |
| 3,062,611 | A | * | 11/1962 | Keen | 264/131 |
| 3,173,427 | A | * | 3/1965 | Tamblyn et al. | 131/342 |
| 3,340,879 | A | * | 9/1967 | Horsewell et al. | 131/334 |
| 3,397,705 | A | * | 8/1968 | Sloan et al. | 131/334 |
| 3,407,822 | A | * | 10/1968 | Touey et al. | 131/332 |
| 3,410,282 | A | * | 11/1968 | Roosevelt et al. | 131/341 |
| 3,428,056 | A | * | 2/1969 | Sublett et al. | 131/342 |
| 3,429,318 | A | * | 2/1969 | Walker et al. | 131/343 |
| 3,618,619 | A | * | 11/1971 | Kiefer | 131/342 |
| 4,763,674 | A | * | 8/1988 | Lelah | 131/342 |
| 4,907,609 | A | * | 3/1990 | Cohen et al. | 131/332 |
| 4,964,426 | A | * | 10/1990 | Lee et al. | 131/342 |
| 5,009,239 | A | * | 4/1991 | Cohen et al. | 131/342 |
| 5,038,803 | A | * | 8/1991 | Cohen et al. | 131/342 |
| 5,462,801 | A | * | 10/1995 | Willmund | 428/372 |
| 5,495,860 | A | * | 3/1996 | Teufel et al. | 131/331 |
| 5,677,058 | A | * | 10/1997 | Neal et al. | 428/375 |
| 6,145,511 | A | | 11/2000 | Teufel et al. | |
| 6,506,873 | B1 | * | 1/2003 | Ryan et al. | 528/354 |
| 6,776,168 | B1 | * | 8/2004 | Teufel et al. | 131/345 |
| 6,814,911 | B2 | * | 11/2004 | Ward et al. | 264/121 |
| 7,261,681 | B2 | * | 8/2007 | Pehmoller et al. | 493/49 |
| 7,428,905 | B2 | * | 9/2008 | Mua | 131/364 |
| 2004/0007687 | A1 | | 1/2004 | Dobbelstein et al. | |
| 2006/0225753 | A1 | * | 10/2006 | Kaczmarek et al. | 131/334 |

FOREIGN PATENT DOCUMENTS

| | | |
|---|---|---|
| WO | WO 91/12737 | 9/1991 |
| WO | WO 91/12737 A1 | 9/1991 |

* cited by examiner

PROCESS FOR MAKING FILTER TOW

This patent application is a U.S. National Phase of International Patent Application No. PCT/GB06/03179, filed Aug. 25, 2006, which claims priority to United Kingdom Patent Application No. 0517551.8, filed Aug. 27, 2005, the disclosures of which are incorporated herein by reference in their entirety.

FIELD OF THE INVENTION

This invention relates to a process for making a crimped tow of filaments, known as filter tow, suitable for conversion into filter rods for use as tobacco smoke filters. The most commonly used filter tows comprise cellulose acetate filaments which are valued for their ability to produce high quality filters.

BACKGROUND OF THE INVENTION

Manufacturers in the tobacco industry are seeking to develop means of selective filtration in order to reduce the levels of certain constituents of main-stream cigarette smoke. For this purpose, various constructions of filter rods have been devised, involving in many cases the use of porous particles having adsorbent surfaces, particularly activated carbon particles. The inclusion of such particles in a filter rod can have a major impact on the efficiency of the filter but can involve more complicated and expensive filter rod manufacturing processes.

One approach has been to have a multi-section filter in which carbon particles are confined to an inner section of the filter, with the part of the filter which goes in the mouth being a standard cellulose acetate filament filter. In a triple-section filter, for example, the middle section may comprise a bed of loose carbon particles. However, a loose bed of particles in the cigarette filter may sometimes be by-passed as a filtration medium by channeling of the smoke stream passing through it.

Another approach has been to include carbon in filter rods by adhering the carbon particles to the filaments through use of plasticizers or adhesives sprayed onto the crimped tow at the filter rod making stage. This approach can however lead to variability in the application of the particles.

Traditionally, additional components for incorporation into cigarette filters have been added at or after the stage of forming filter rods from crimped tow. For example, U.S. Pat. No. 6,145,511 discloses the addition of various compounds to filters during conventional filter rod manufacture. It is stated that the additional components are mixed with the traditional plasticiser triacetin in the rod maker process.

The processes described above which involve the incorporation of additional components at the rod making stage add complexity to the rod making process. Furthermore, some processes are inflexible in that the rod making machine often needs to be custom designed or require extensive modification to perform the step of adding the particular substance in question.

Another approach to incorporating additional components is disclosed in WO 91/12737. This document discloses the step of dissolving acidic compounds into a cellulose acetate spinning solution prior to spinning filaments for use in the manufacture of a filter. The incorporation of acidic materials into the spinning solution is intended to alter the nicotine to tar ratio in filtered cigarette smoke.

The present invention seeks to provide an improved method for the manufacture of filter tow, which may be used in the manufacture of filter rods and cigarettes. The present invention also seeks to provide improved filter tow.

DISCLOSURE OF THE INVENTION

According to one aspect of the present invention, there is provided a method of preparing a crimped tow of cellulose acetate filaments comprising the steps of:

providing cellulose acetate dope forming filaments from the dope applying at least one additive to the filaments crimping the filaments to form a crimped tow wherein the at least one additive is capable of removing a component from cigarette smoke.

Preferably, the at least one additive comprises a solution, emulsion, liquid, or particulate material or combinations thereof.

Conveniently, the at least one additive comprises an acidic compound or an alkaline compound.

Advantageously, the at least one additive comprises malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate and carboxylated acrylate.

Preferably, the at least one additive comprises particles of carbon, silica, zeolite, clay, alumina, metal, molecular sieves or an ion exchange resin.

Conveniently, the carbon comprises activated carbon.

Advantageously, the particles comprise a material capable of generating a gaseous emission.

Preferably, the material is a liquid which can volatilized to generate a gas or vapour by the action of heat and/or reduced pressure.

Conveniently, the material is water.

Advantageously, the method further comprises the step of steeping the particles in water before application to the filaments.

Preferably, the at least one additive is applied to the filaments using an adhesive.

Conveniently, the adhesive comprises a cellulose ether.

Advantageously, the adhesive comprises methyl cellulose.

Preferably, the method further comprises the step of applying a shed suppressor to the filaments.

Conveniently, the shed suppressor is glycerol.

Advantageously, the filaments have a non-circular cross-section.

Preferably, the filaments have a multi-lobal cross-section.

Conveniently, the component is a Hoffmann analyte.

Advantageously, the component comprises hydrogen cyanide, formaldehyde, pyridine, quinoline or phenol.

Preferably, the step of forming filaments from the dope comprises extruding the dope through a spinneret to form an array of filaments, and drying the filaments to remove a dope solvent.

Conveniently, the at least one additive is applied to the filaments during the drying step.

Advantageously, the at least one additive is applied to the filaments after the drying step.

Preferably, the method comprises the step of combining the filaments produced by a plurality of spinnerets to produce a banded tow of filaments.

Conveniently, the at least one additive is applied to the filaments before formation of the banded tow.

Advantageously, the at least one additive is applied to the filaments after formation of the banded tow.

Preferably, the at least one additive is applied to the filaments immediately before the step of crimping to form the crimped tow.

Conveniently, the at least one additive comprises a plurality of additives.

Advantageously, the plurality of additives comprises two additives.

Preferably, the plurality of additives comprises three additives.

Conveniently, the plurality of additives are applied separately to the filaments.

Advantageously, the plurality of additives are applied concurrently to the filaments.

Preferably, the plurality of additives are applied sequentially to the filaments.

Conveniently, each of the plurality of additives is incorporated into a substantially separate portion of the filaments.

Advantageously, the method comprises the step of applying the plurality of additives to the banded tow in stripes.

Preferably, the step of applying the plurality of additives to the banded tow in stripes further comprises the application of a barrier material between adjacent stripes.

Conveniently, the barrier material comprises white oil.

Advantageously, the step of forming filaments from the dope comprises extruding the dope through a spinneret to form an array of filaments, and drying the filaments to remove a dope solvent.

Preferably, one of the plurality of additives is applied to the filaments during the drying step and another of the plurality of additives is applied to the filaments after the drying step.

Conveniently, one of the plurality of additives is applied to the filaments formed by a first spinnerette and another of the plurality of additives is applied to the filaments formed by a second spinnerette.

Advantageously, the step of providing cellulose acetate dope comprises incorporating at least one additive into the dope.

Preferably, the method further comprises the step of plaiting the crimped tow of filaments into a bale.

Advantageously, the method further comprises the step of forming a filter rod from the crimped tow of filaments.

Preferably, the step of forming a filter rod further comprises incorporating at least one additive into the filter rod.

Advantageously, a particulate additive is incorporated into the tow of filaments.

Preferably, a particulate additive is incorporated into a cavity in the filter rod.

Conveniently, the step of forming a filter rod comprises combining a plurality of filter rod segments together to form the filter rod.

Preferably, each of the plurality of filter rod segments comprises filaments that incorporate a different additive.

Conveniently, the filter rod comprises three filter rod segments.

Advantageously, the method further comprises the step of forming a cigarette from the filter rod.

According to another aspect of the invention, there is provided a crimped tow of cellulose acetate filaments obtainable by a method as defined above.

According to a further aspect of the invention, there is provided a bale of tow obtainable by a method as defined above.

Preferably, the bale of tow is suitable for use on a conventional rod-maker with little or no modification being necessary.

According to a yet further aspect of the present invention, there is provided a filter rod obtainable by a method as defined above According to yet another aspect of the present invention, there is provided a cigarette obtainable by a method as defined above.

The invention may include one or more of the following preferred features.

Preferably, if the at least one additive comprises particles, then the particles are applied to the filaments before the formation of a banded tow.

Conveniently, if the at least one additive comprises particles, then the particles are not pre-treated to load them with a material capable of generating a gaseous emission from the particles.

Advantageously, if the at least one additive comprises particles, then an adhesive is not used to bond the particles to the filaments.

The present invention will now be described, by way of example, with reference to the accompanying drawings in which.

Figure 1:
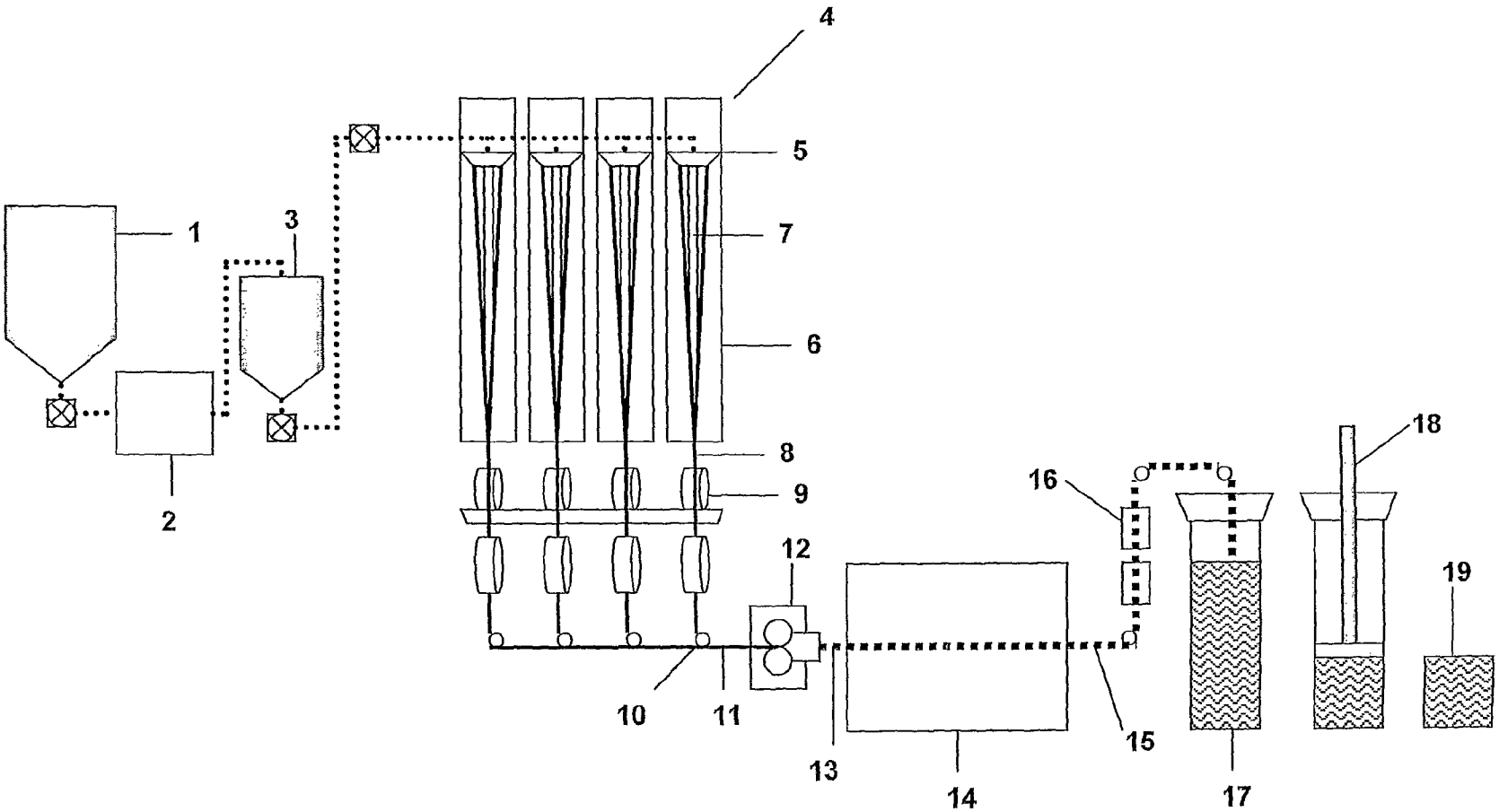
FIG. 1 is a schematic diagram showing the typical production of cellulose acetate tow.

The conventional method of manufacturing cellulose acetate filter tow will now be described with reference to FIG. 1. The starting material is typically cellulose acetate flake which has been prepared from wood pulp. The cellulose acetate flake is dissolved in a solvent comprising about ~97% acetone and ~3% water in a mixer 1 to form a relatively viscous solution known as spinning dope. After dissolution, the dope typically undergoes a two stage filtration process by being pumped through a filter system 2 in order to remove fibrous or particulate matter which would otherwise cause problems with the subsequent spinning step. After filtration, the filtered dope is passed into a storage tank 3 before being preheated and pumped to an array of spinning cells 4.

Each spinning cell 4 comprises a spinneret 5 positioned above a relatively long drying chamber 6. The spinneret 5 has a head which typically comprises several hundred small holes through which the dope is extruded under pressure. The holes may be, for example, circular, triangular, square or rectangular that give rise to filaments having crenellated, "Y", "X" and dog-bone shaped cross-sections respectively. After being extruded through the spinneret 5, the dope forms an array of filaments 7 which are passed down through the drying chamber 6 which acts to remove the majority of the dope solvent. This normally involved the passing of a counter current of heated air which serves to evaporate most of the acetone from the extruded array of filaments 7. During the drying step, the array of filaments 7 is gathered together to form a gathered array of filaments 8 which leaves the drying chamber 6.

After leaving the drying spinning cell 4, it is normal to apply "spin finish" to the gathered array of filaments 8 in order to provide beneficial properties. The spin finish normally comprises an oil-in-water emulsion containing white oil and surfactants. This serves to protect the filaments from abrasion, imparts reduced friction and avoids electrostatic problems. Spin finish is applied by passing the gathered array of filaments 8 over a roller 9 which dips into a reservoir of spin finish.

As each spinning cell produces a relatively small amount of filaments, the output from a number of spinning cells, for example from 25 to 100 but typically in the region of 50, is consolidated to form a ribbon or band of filaments known as a banded tow. For clarity, only four spinning cells are shown in FIG. 1. As shown, the output of each of the spinning cells 4 is consolidated by a series of guides 10 to form the banded tow 11.

The banded tow 11 contains a large number of individual filaments, typically in the region of 2,000 to 40,000. In order to form a coherent banded tow that opens as a coherent web at the filter rod making stage and to impart properties to the tow that enables a stable filter rod to be made, the banded tow undergoes a crimping step involving the passage of the banded tow through a crimper 12 which imparts a generally sinusoidal shaped crimp along the length of the tow. This is typically performed by passing the banded tow 11 through a pair of rollers and box known as "stuffer-box" crimping.

The crimped banded tow 13 is then passed through a conditioner 14 which contains a number of zones of different temperature and humidity in order to ensure that the crimped tow 13 has had most of the residual solvent removed and has been restored to the tow's natural regain of moisture.

Although not a normal step in traditional tow manufacture, the conditioned crimped tow 15 may be subjected to a stretching step by passing through a pair of rollers 16 operating at slightly different speeds. This stretching step may be useful in the method of the present invention, as discussed in more detail below.

The crimped tow 15 is then carefully plaited into a container 17 and subsequently compressed by a hydraulic press 18 in order to give a bale of crimped tow 19. The bale 19 may then be sold to filter rod or cigarette manufacturers for processing into cigarette filter rods and subsequent incorporation into cigarettes.

The compressed tow 19 provides a convenient compact unit known as a bale containing a relatively long length of crimped tow 15 for the preparation of cigarette filter rods. This process involves the pulling of one end of the crimped tow 15 from the bale 19 and passage through a rod maker machine which produces the cigarette filter rods. In this process, the crimped tow 15 passes over a number of mechanical and/or air spreading devices to open up the web of the tow. During the final spreading step the web of stretched tow is sprayed with a plasticiser (typically triacetin) before passing through a garniture which funnels the stretched web of tow into a circular shape and packages the circular plug of filter with a paper casing. The paper-wrapped filter plug is then chopped into individual filter rods for use in subsequent steps to prepare cigarettes. These subsequent steps typically involve the cutting of the filter rods into individual cigarette filters followed by their combination with rods of tobacco to form complete filter cigarettes.

As previously mentioned, there are numerous examples in the prior art of the incorporation of additional components to the crimped tow at the rod making stage. This may involve the stretched plasticised web of tow being showered with carbon particles. Some of the carbon particles will thus become entrapped within the filaments of the web of filtered tow before formation of the filters.

This process results in a proportion of the carbon particles either passing through the web or being bounced off the web. These excess particles need to be safely collected within the manufacturing environment for recycling or disposal.

It would be very beneficial to provide a bale of crimped tow which already incorporates an additional component or components which may then be used on traditional rod-making machines with no or minimal changes to produce filters that can or have the potential to remove or reduce the level of certain constituents of mainstream smoke.

Furthermore, this approach also allows the use of dispersions, solutions, liquids or emulsions which would not be compatible with addition at the rod making stage. The speed that filter tow passes through a rod maker machine means that there is only a fraction of a second between the addition of a component to the stretched web of tow and the formation of a filter rod from that tow. Thus, a solution, liquid, emulsion or dispersion of an additive introduced at the rod-maker stage would have little time to dry before the formation of the final filter rod. This could lead to many problems such as the deterioration of the paper casing, clogging of the garniture, tape, cutting and rod feed mechanisms and/or retraction of fibre in the rods. However, if the solution of filter tow is applied at a stage in the manufacture before the rod maker, then sufficient time may be allowed for necessary drying of the various additives.

There has been increased interest in the selective reduction of levels of certain components of cigarette smoke. In particular, a group of compounds known as the Hoffmann analytes have been identified as targets for selective reduction. The list of Hoffman analytes comprises a wide range of different chemicals and components which are present in various quantities in cigarette smoke. Currently listed compounds of particular interest include hydrogen cyanide, pyridine, quinoline, phenol, acetaldehyde, methanol, isoprene, acetone, acrolein, and various aldehydes such as propionaldehyde, crotonaldehyde, butyraldehyde, methyl ethyl ketone, 1,3-butadiene, acrylonitrile, benzene, toluene and styrene. It is also of interest to reduce and/or differentially modify the levels of tar and nicotine in the smoke.

One definition of the Hoffmann list of analytes is set out below:

Inorganic Gases
Carbon Monoxide (CO)
Hydrogen cyanide (HCN)
Cyanogen $(CN)_2$
Carbon disulphide $(CS)_2$
Ammonia $(NH)_3$
Oxides of nitrogen $(NO_x)$
Hydrogen sulphide $(H_2S)$
Hydrazine $(N_2H_4)$ Metals
Mercury
Nickel
Lead
Cadmium
Chromium
Arsenic
Selenium
Aldehydes
Formaldehyde ($H_2CO$)
Acetaldehyde ($CH_3CHO$)
Acrolein ($CH_2{=}CHCHO$)
Crotonaldehyde ($CH_3CH{=}CHCHO$)
Proprionaldehde ($CH_3CH_2CHO$)
Poly Aromatic Hydrocarbons
Benz(a)anthracene ($C_{18}H_{12}$)
Benzo(b)fluoroanthene ($C_{20}H_{12}$)
Benzo(l)fluoroanthene ($C_{20}H_{12}$)
Benzo(k)fluoroanthene ($C_{20}H_{12}$)
Benzo(a)pyrene ($C_{20}H_{12}$)
Dibenzo(a,h)anthracene
Dibenzo(a,l)pyrene
Dibenzo(a,e)pyrene
Indeno(1,2,3-cd)pyrene
5-Methylchrysene ($C_{19}H_{14}$)
Volatile Hydrocarbons
1,3-Butadiene
Isoprene
Benzene
Styrene
Heterocyclic Compounds
Pyridine ($C_3H_5N$)
Nicotine ($C_6H_4C_4H_7NCH_2$)
Quinoline ($C_9H_7N$)
Dibenz(a,h)acridine ($C_{13}H_9N$)
Dibenz(a,j)acridine ($C_{13}H_9N$)
7H-dibenzo(c,g)carbazole ($C_{12}H_9N$)
Furan ($C_4H_4O$)
Benzo(b)furan ($C_8H_6O$)
Aromatic Amines
Aniline ($C_6H_5NH_2$)
2-Toluidine ($CH_3C_6H_4NH_2$)
2-Naphthylamine ($C_{10}H_7NH_2$)
4-Aminobiphenyl ($C_6H_5C_6H_4NH_2$)
N-Heterocyclic Amines
2-Amino-9H-pyrido(2,3-b)indole
2-Amino-3-methyl-9H-pyrido(2,3-b)indole
2-Amino-3-methylimidazo(4,5-b)quinoline
3-Amino-1,4-dimethyl-5H-pyrido(4,3-b)indole
3-Amino-1-methyl-5H-pyrido(4,3-b)indole
2-Amino-6-methyl(1,2-a:3,2-d)imidazole
2-Aminodipyrido(1,2-a:3,2-d)imidazole
2-Amino-1-methyl-6-phenylimidazo(4,5-1)pyridine
N-Nitrosamines
N-Nitrosodimethylamine ($(CH_3)_2NNO$)
N-Nitrosoethylmethylamine ($(CH_3CH_2)(CH_3)NNO$)
N Nitrosodiethylamine ($(CH_3CH_2)_2NNO$)
N-Nitroso-di-n-propylamine ($(CH_3(CH_2)_2)_2NNO$)
N-Nitroso-di-n-butylamine ($(CH_3(CH_2)_3)_2NNO$)
N-Nitrosopyrrolidine ($(C_4H_8NNO)$)
N-Nitrosopiperidine ($(C_5H_{10}NNO)$)
N-Nitroso-diethanolamine
N-Nitrosonornicotine
N-Nitrosoanabasine
4-(Methylnitrosamino)-1-(3-pyridyl)-1-butanone
Miscellaneous Organic
Methanol ($CH_3OH$)
Acetamide ($CH_3CONH_2$)
Acrylamide ($CH_2{=}CHC(CH_3){=}CH_2$)
Acrylonitrile ($CH_2{=}CHCN$)
Acetonitrile ($CH_3CN$)
Vinyl Chloride ($CH_2{=}CHCl$)
Ethylene Oxide ($CH_2CH_2O$)
Ethyl Carbamate ($C_2H_5CO_2NH_2$)
1,1-Dimethylhydrazine ($(CH_3)_2NNH_2$)
Maleic Hydrazide ($C_4H_4O_2N_2$)
Methyl ioscyanate ($C_2H_3NO$)
2-Nitropropane ($(CH)_3CHNO_2$)
Nitrobenzene ($C_6H_5NO_2$)
Phenol ($C_6H_5OH$)
Catechol ($C_6H_4$-1,2-$(OH)_2$)
Dioctylphthalate
DDT ($(ClC_6H_4)_2CHCCl_3$)
DDE ($(ClC_6H_4)_2C{=}CCl_2$)

The present invention is concerned with the incorporation of one or more additives into filter tow during the manufacturing stage which may remove components of main-stream cigarette smoke, and in particular to remove Hoffmann analytes from cigarette smoke. By "remove" it is meant that the level of the component in cigarette smoke may be reduced or completely removed by a filter of the present invention in comparison to an equivalent filter which does not contain any such additives.

Preferred additives which may be used in the present invention are set out below:

Malic acid
Potassium carbonate
Citric acid
Tartaric acid
Lactic acid
Ascorbic acid
Polyethyleneimine
Cyclodextrin
Sodium hydroxide
Sulphamic acid
Sodium sulphamate
Polyvinyl acetate
Carboxylated acrylate
Carbon
Silica
Zeolite
Clay
Alumina
Metal
Molecular sieves
Ion exchange resins
Activated carbon
Acetate fibrils
Antioxidants
Proanthocyanidin
Impregnated carbon
Impregnated zeolites
Sodium carbonate
Sodium bicarbonate
Ammonium carbonate
Glycerol
Sodium silicate
Amino acids
Nitrogen-containing heterocycles
Polyamide
Aminopropylsilyl derivatised silica gel
Tributyl phosphate Triethyl citrate
Encapsulated liquids
Sodium chloride+base
Plasticisers
Meltable waxes
Trimethyl octadecylammonium stearate
Quaternary compounds
Petroleum jelly
Sugar esters
Vegetable oils
Low boiling alkyl or hydroxy alkyl amine or double amine salts with inorganic salt of iron group and a colloidal metal hydroxide
Halogen-containing compounds
Vermiculite
Ferrous ferrite
Zirconium-containing solids
Polymeric hydrazides
Oxidative porphyrin
Slightly polymerised furfural
Desoxycholic acid
Polymeric amine salts
Collagen
Calcium silicate
Calcium alginate
Glutathione
Hydrate of double salt of ferroso-ferric chloride
Vitamin E
Hydroxycinnamic acids
Sodium percarbonate
Magnesium silicate
Quaternary ammonium acetate
Proteins (casein, gelatin, zein, soy bean, wheat gluten)
Activated silica gel
Amino acid derivatives
Polymeric amines
Sugars
Water soluble resins (PEO etc)
Expanded pearlite
Polyurethanes
Aromatic resins
Dextrans
Polyolefins
Tourmaline
Sodium pyroglutamate
Polyvalent metal salt of an acid
Platinum
Fullerene derivatives
Poly(arylene thioether)
Saturated cyclic secondary amine
Manganese oxide/dihydroxide
Gold
Silver
Metal co-ordination complex
Metal phthalocyanine
Ferrous sulphate
Hydrotalcite
Fatty acid
Fatty acid ester
Iron aluminide
Iron aluminum carbide
Titanium aluminide
Ammonium bicarbonate
Copper ceria nano particles
Tetrasodium salt of ethylenediaminetetraacetic acid
Palladium
Polyphenols
Enediols
H—S—X—$SO_3H$
Humic acid
Ellagic acid
p-Aminobenzoic acid
Sorbic acid
Undecylenic acid
Silicic acid
Oil of anise, star anise oil, fennel oil, anethole, methyl chavicol, anisic acid and mixtures
Copper zinc alloy
Metal oxide oxidation catalyst
Spinel ferrite catalyst
Nitrided transition metal oxide nanoscale particles
Transition metal ethylene diamine complex
Magnesium chloride
Zinc oxide+carbonate
Thiol-functionalized sorbents
Chitosan
Nanoparticles—clay—or organically modified
Volcanic ash
Polycarboxylic acids
OUTLAST capsules with higher melting waxes
Isinglass
Sodium hydrogen carbonate
Clathrates
Starches
Poly hydroxy alkanoates
Nano titanium dioxide
Coated nano titanium dioxide
Polyvinylalcohol
Polyacrylamide
Quat-ammonium salts
Haemoglobin
Porphyrin ring compounds
Alumino zinc compounds
Mica
DNA
Water absorbent polymers
Silica gel
Meerschaum
Aluminum oxide
Triacetin
Calcium carbonate
Low melting polyethylene
Poly ethylene ethylacrylic acid
Nanosponges
Copper based cage structures
Propyl gallate
Copper included zeolites
Monoclonal antibodies
Diatom shells
Alpha-tocopherol
Dendrimer catalysts
Protein nanotubes
Layered double hydroxides
Molecularly imprinted polymers
Fluorinated mesoporous silica
Diatomaceous earth
Non-graphite nano-tubes
Prussian blue analogue
Selective nanocapsule
Nanometric metals, oxides, carbides and nitrides
Alumina
TAHT—colourless dye chemistry
Oligosaccharides of cellulose diacetate
Ruthenium+cerium oxide ($CeO_2$)

Figure 2:
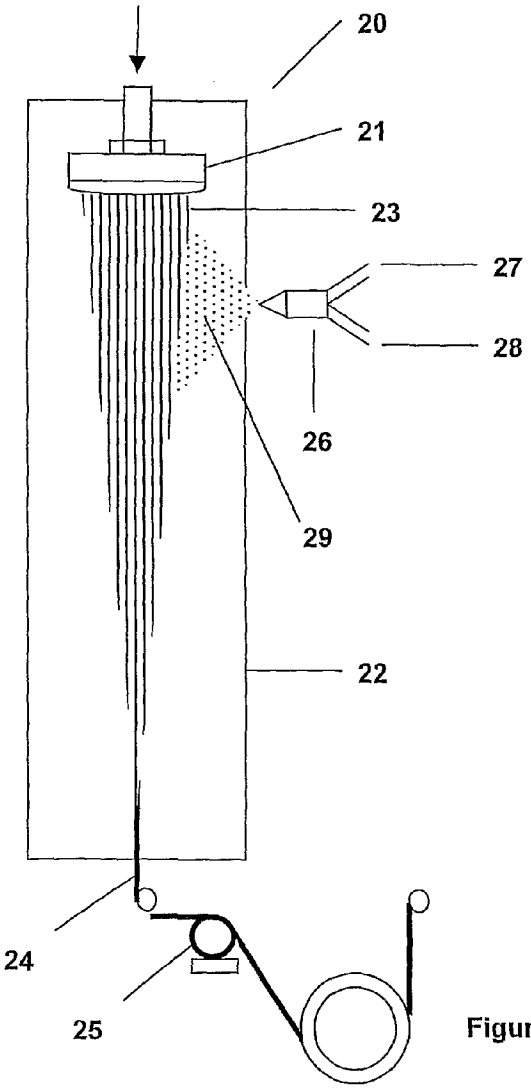
FIG. 2 is a schematic view of a solution of additive being introduced into a spinning cell.

Poly(ethylene glycol) PEG
Amine salts
Chlorella algae
Sodium or potassium phosphite
Ammonium sulphate
Silver permanganate
Magnesium trisilicate
Sepiolite
Molecular sieves With reference to FIG. 2 a preferred aspect of the present invention is illustrated with reference to a spinning cell 20. The spinning cell 20 comprises a spinnerette 21 positioned above a drying chamber 22. As shown, dope is extruded through the spinneret head 21 to produce an array of filaments 23. The filaments 23 are passed through the elongated drying chamber 22 against a counter current of heated air. The heated air serves to remove the majority of the acetone from the extruded array of filaments 23. The array of filaments is gathered together at the bottom of the chamber 22 to give a gathered array of filaments 24, which is passed over a roller 25 which applies spin finish and then passed onto further manufacturing processes.

An additive may be incorporated into the array of filaments 23 at this stage as shown. A dispersion of a particulate material may be incorporated into the filament at this stage by spraying an aerosol at the array of filaments. FIG. 2 shows the addition of particulate calcium carbonate to the filaments 23. A spray nozzle 26 is provided having an inlet 27 for compressed air and an inlet 28 for particulate calcium carbonate. The particulate calcium carbonate is blown into the drying chamber 22 to impact upon the filaments 23. This results in effective incorporation of the particulate material into the filaments. This technique is applicable to other forms of additive, including solutions, liquids, and emulsions.

Figure 3:
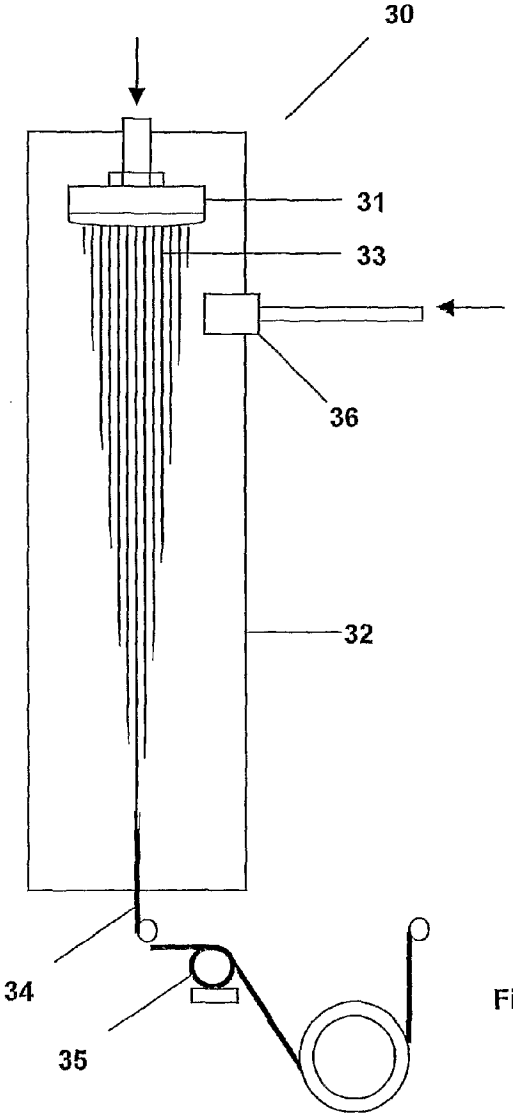
FIG. 3 is a schematic view of a particulate additive being introduced into a spinning cell.

FIG. 3 shows a variation of this aspect of the invention. A spinning cell 30 is shown having a spinnerette 31 above a drying chamber 32. Dope is pumped through the spinneret 31 to form an array of filaments 33. After passing through the drying chamber, the gathered filaments 34 pass over a roller 35 which applies spin finish. Positioned in the drying chamber 32 is a metered stream application system (MSA) 36. The MSA 36 effectively incorporates an additive into the filaments 33 as they pass through the drying chamber 32. MSA comprises a metering pump that pumps a fluid to a guide having an aperture that allows the fluid to be applied directly onto the fibres surface. The fluid could be a dispersion, liquid, emulsion or solution.

Figure 4:
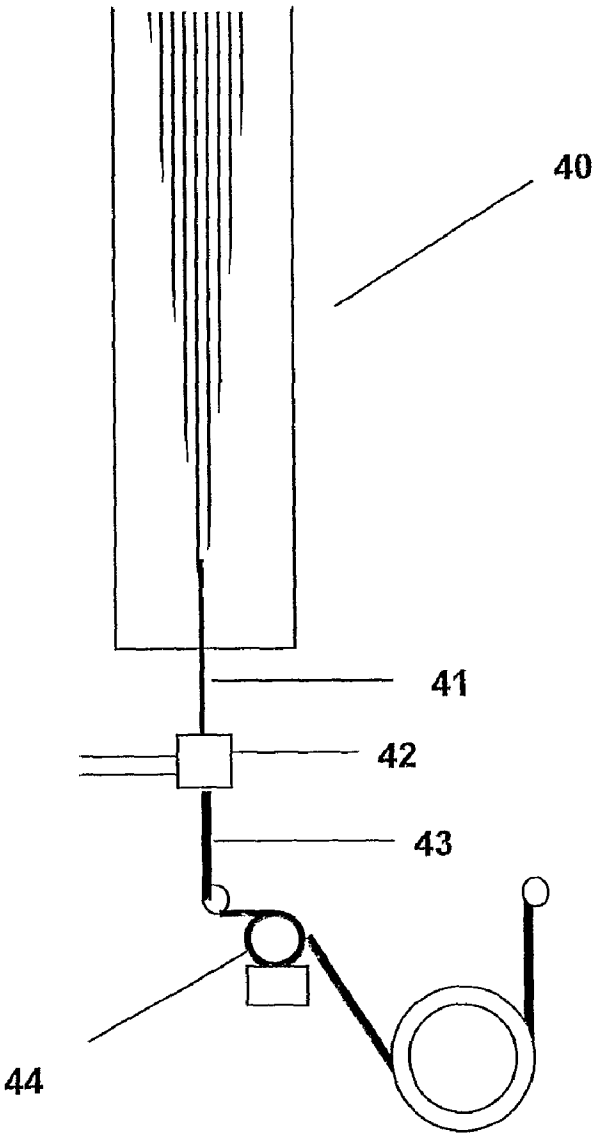
FIG. 4 is a schematic view of an additive being applied to filaments immediately after leaving a spinning cell.

An alternative method of introducing additional components into the filtered tow is shown in FIG. 4. A spinning cell 40 is shown producing gathered filaments 41. The filaments 41 pass through an applicator system 42 which applies an additive to the filaments. The treated filaments 43 then pass over a spin finish roller 44 before continuing on the manufacture process. The applicator system 42 may comprises a roller, a spray, a MSA system or other suitable systems known in the art. A preferred applicator system is a MSA such as that shown in FIG. 3

Figure 5:
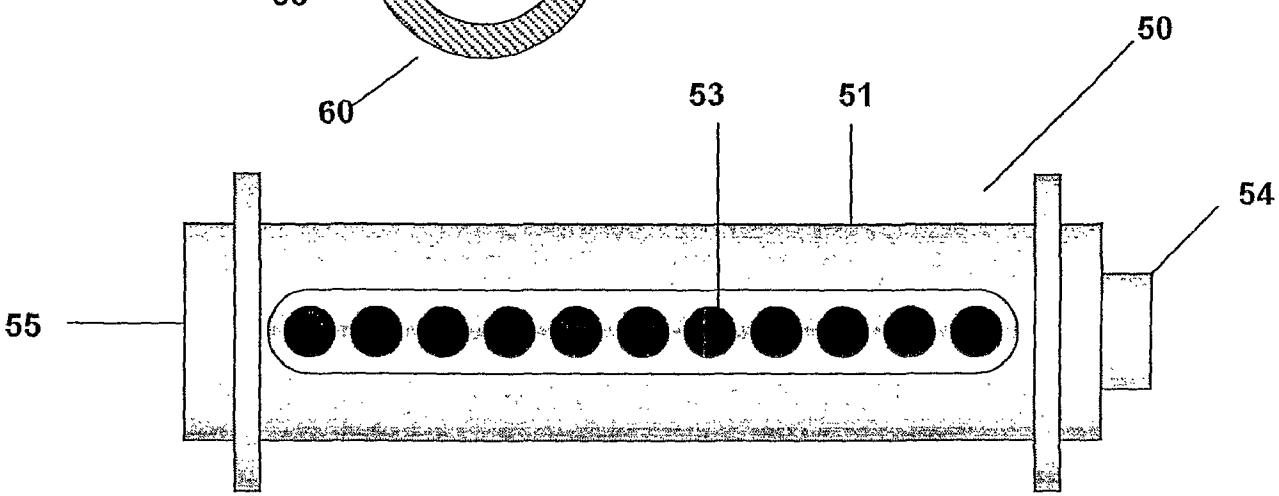
FIG. 5 is a plan view of an applicator for applying an additive to a tow of filaments.

FIG. 5 shows an applicator 50 for use in the present invention. The applicator 50 has a generally tubular shape, comprising a cylindrical side wall 51 surrounding an inner plenum chamber 52. A series of apertures 53 are provided in the side wall 51 along the length of the applicator 50. The length of the series of apertures 53 is substantially equal to the width of a banded tow of filaments. One end of the applicator 50 is provided with an additive inlet 54 and the other end is closed off by an end wall 55. Thus, an additive may be introduced via the inlet 54 into the interior 52 of the applicator 50 in the form of a solution, liquid, emulsion or dispersion. The additive may then pass through the apertures 53 and be applied to the banded tow.

Figure 6:
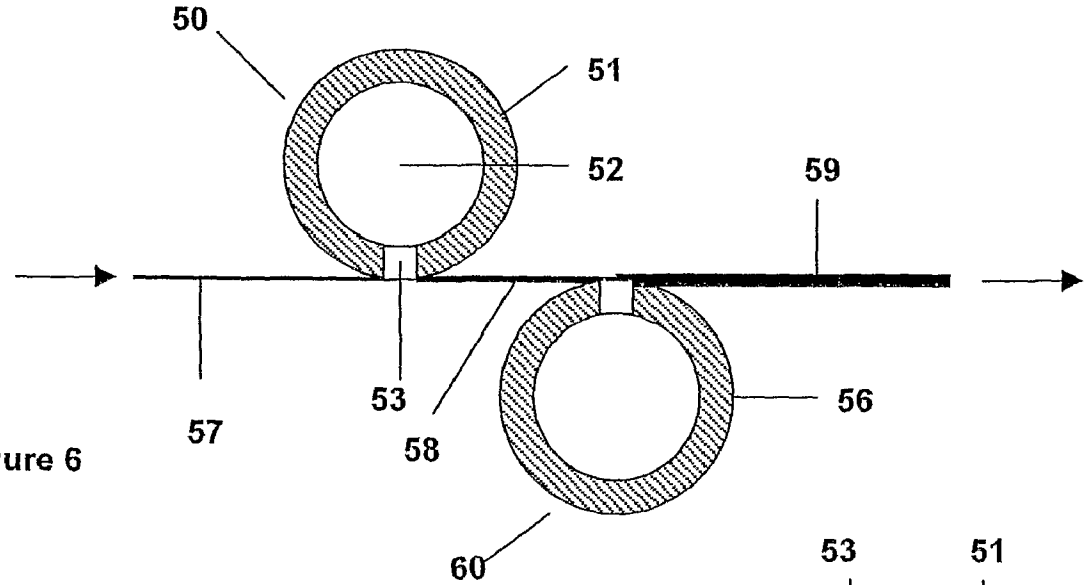
FIG. 6 is a cross-sectional view of a banded tow of filaments passing through a pair of applicators as shown in FIG. 5.

FIG. 6 shows how the applicator 50 may be used in practice to apply an additive to both sides of a banded tow of acetate. As mentioned above, the output from a number of spinnerets is typically gathered together and arranged to provide a wide flat ribbon comprising several thousand individual filaments. Although the output from a wide range of numbers of spinnerets may be gathered together, for example 25 to 100, typically the output of around 50 to 70 spinneret heads is used to produce a banded tow 57. The banded tow 57 passes through a pair of applicators, with a first applicator 50 in contact with the upper face of the banded tow 57, and a second applicator 60 in contact with the lower face of the banded tow 57. The second applicator 60 is of similar construction to the first applicator 50. The first and second applicators 50 and 60 are arranged with offset apertures to ensure the even application of additive across the full width of the banded tow 57.

As the banded tow 57 passes against the first applicator 50, the additive is applied across its upper face to give a partially treated tow 58. The partially treated tow 58 then passes against the second applicator 60 which applies additive across its lower face to give the final treated tow 59. Thus, a solution, emulsion, liquid or dispersion of additive or additives may be applied to both sides of the banded tow. Solvents, liquids, dispersants, adhesives and or shed suppressors may be used during the application of additives. An "adhesive" is generally a solid and a "shed suppressor" is generally a liquid.

Preferred adhesives which may be used in the present invention are set out below:

PVP
Methyl Cellulose
Propyl cellulose
Poly(vinyl alcohol)
Poly(vinyl acetate)
Poly(ethyleneimine)
Poly(ethylene oxide)
Dextrin
Polyethylene glycols (PEGs)
Carboxymethylcellulose
Poly acrylic acids (PAA)
Acrylic resins
Triacetin
Triethylene glycol diacrylate (TEGDA)
Diethylene glycol diacrylate (DEGDA)
Resins
Phenolic
Epoxides
Silicones
Cyanoacrylates
Polyurethanes
Polysulfides
Starch Preferred shed suppressors which may be used in the present invention are set out below:

Glycerol
Sodium silicate
Low molecular weight polyethylene glycols (PEGs)
Low melting waxes
Ethylene Glycol
Sorbitol
Propylene glycol
Sodium lactate
Calcium chloride
Potassium phosphate
Sodium pyrophosphate Sodium polyphosphate
Calcium citrate
Calcium gluconate
Potassium citrate
Potassium gluconate
Sodium tartrate
Sodium potassium tartrate
Sodium glutamate
Vegetable oils
Mineral oils The treated tow 59 may then be passed through a crimper in order to produce a crimped tow. The coated tow 59 may then be passed through dryers which are well known in the art. As mentioned above, the tow may undergo a stretching step. In particular, a stretching step may be necessary if the fibres have become partially bonded to each other in order to restore some of the openability of the treated banded tow. The crimped tow may then be plaited into bales for later use. This has the advantage that a conventional filter rod making process and machine may be used with a bale of tow according to the present invention which has been previously treated with additives. The treated tow may be used in a conventional filter rod making machine with little or no modifications being required. The resulting cigarettes may then have the capability of selectively reducing the amount of certain components of cigarette smoke.

One advantage of the invention is that additives may be consistently applied to the filaments. In particular, a dispersion of particulate additive (such as activated carbon powder) may be applied to give a tow of filaments having a consistent amount of additive per unit length. This is to be contrasted with the prior art method of incorporating particulate material at the rod-maker stage which can lead to variable and inconsistent loading of the resultant filter rods.

Another particularly advantageous feature of the present invention is that a number of different components or additives may be incorporated into the tow during manufacture. For example, the list of Hoffmann analytes include acidic compounds and alkaline compounds. These may require different additives in order to reduce their concentration in mainstream smoke. For example, an acidic tow additive may remove an alkaline analyte whilst an alkaline tow additive may reduce an acidic analyte. However, the mixing of an acidic additive with an alkaline additive would simply lead to neutralisation and thus loss of activity and/or reactivity. It would therefore be beneficial to incorporate both acidic and alkaline additives into the tow whilst retaining their individual activity and reactivity. The present invention provides solutions to this particular problem which are also applicable to other additives which are not compatible with each other.

Figure 7:
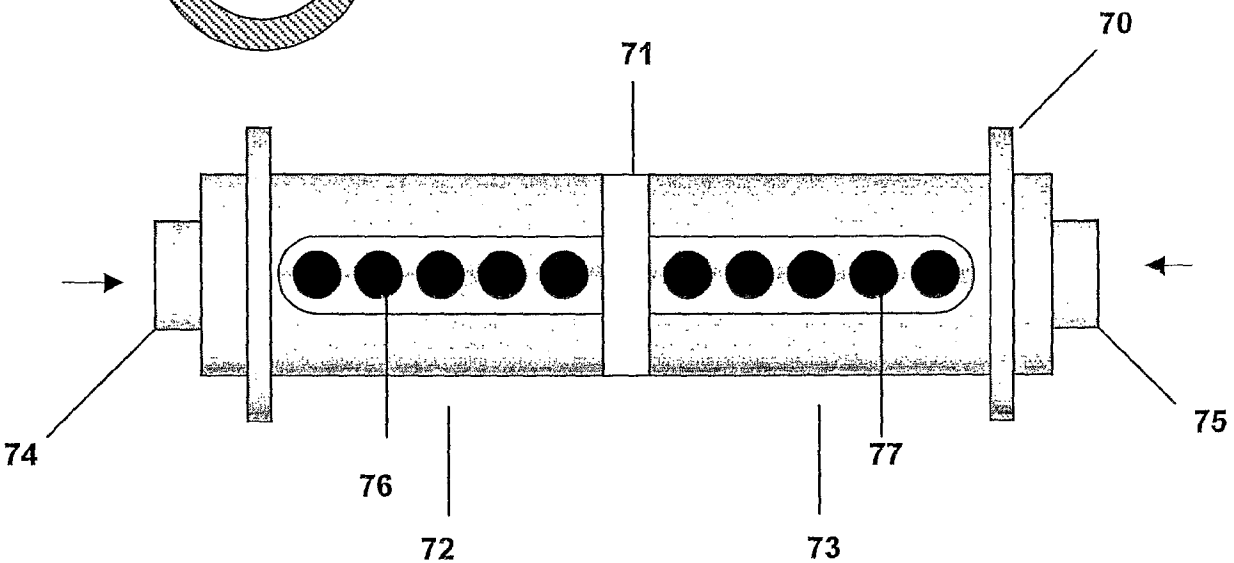
FIG. 7 is a plan view of an applicator for applying two additives to a tow of filaments.

Another applicator 70 is shown in FIG. 7 that has two separate applicator zones which allow for the separate and concurrent application of two different additives to tow. The applicator 70 corresponds to the applicator 50 shown in FIG. 5 except that it has a barrier 71 positioned within the interior plenum chamber about midway along the length of the applicator 70, forming two separate applicator zones 72 and 73. One end of the applicator has a first additive inlet 74 leading to a series of apertures 76 which form a first applicator zone 72. The other end of the applicator has a second additive inlet 75 leading to a series of apertures 77 which form a second applicator zone 73.

Figure 8:
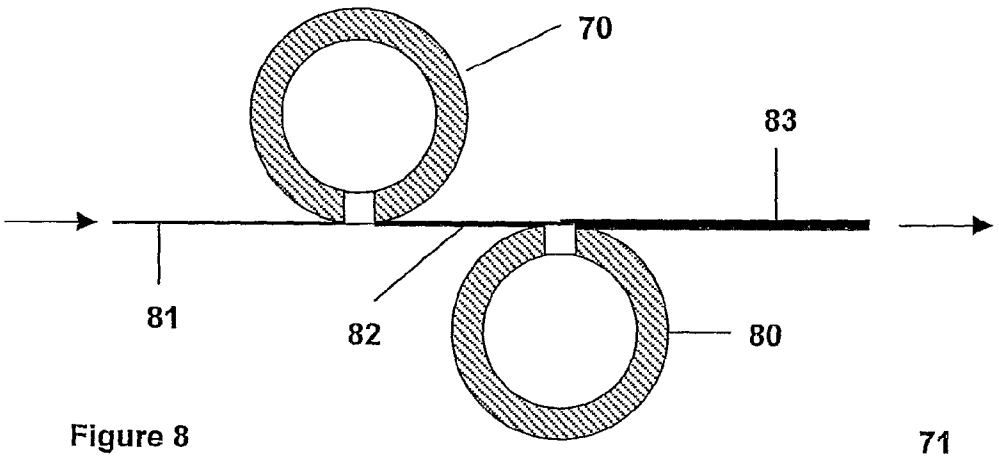
FIG. 8 is a cross-sectional view of a banded tow of filaments passing through a pair of applicators as shown in FIG. 7.

FIG. 8 shows how the applicator 70 may be used in practice. A banded tow of filaments 81 passes against a pair of applicators comprising a first applicator 70 and a second applicator 80. The banded tow 81 passes through a pair of applicators, with a first applicator 70 in contact with the upper face of the banded tow 81, and a second applicator 80 in contact with the lower face of the banded tow 81. The second applicator 80 is of similar construction to the first applicator 70. The first and second applicators 70 and 80 are arranged with offset apertures to ensure the even application of additive across the full width of the banded tow 81.

As the banded tow 81 passes against the first applicator 80, the two additives are applied across its upper face by the two applicator zones to give a partially treated tow 82. The partially treated tow 82 then passes against the second applicator 80 which applies the two additives across its lower face to give the final treated tow 83. The treated tow has two stripes of additives along its length. This aspect allows an acidic additive to be applied to one half of the banded tow with an alkaline additive being added to the other half of the banded tow.

Figure 9:
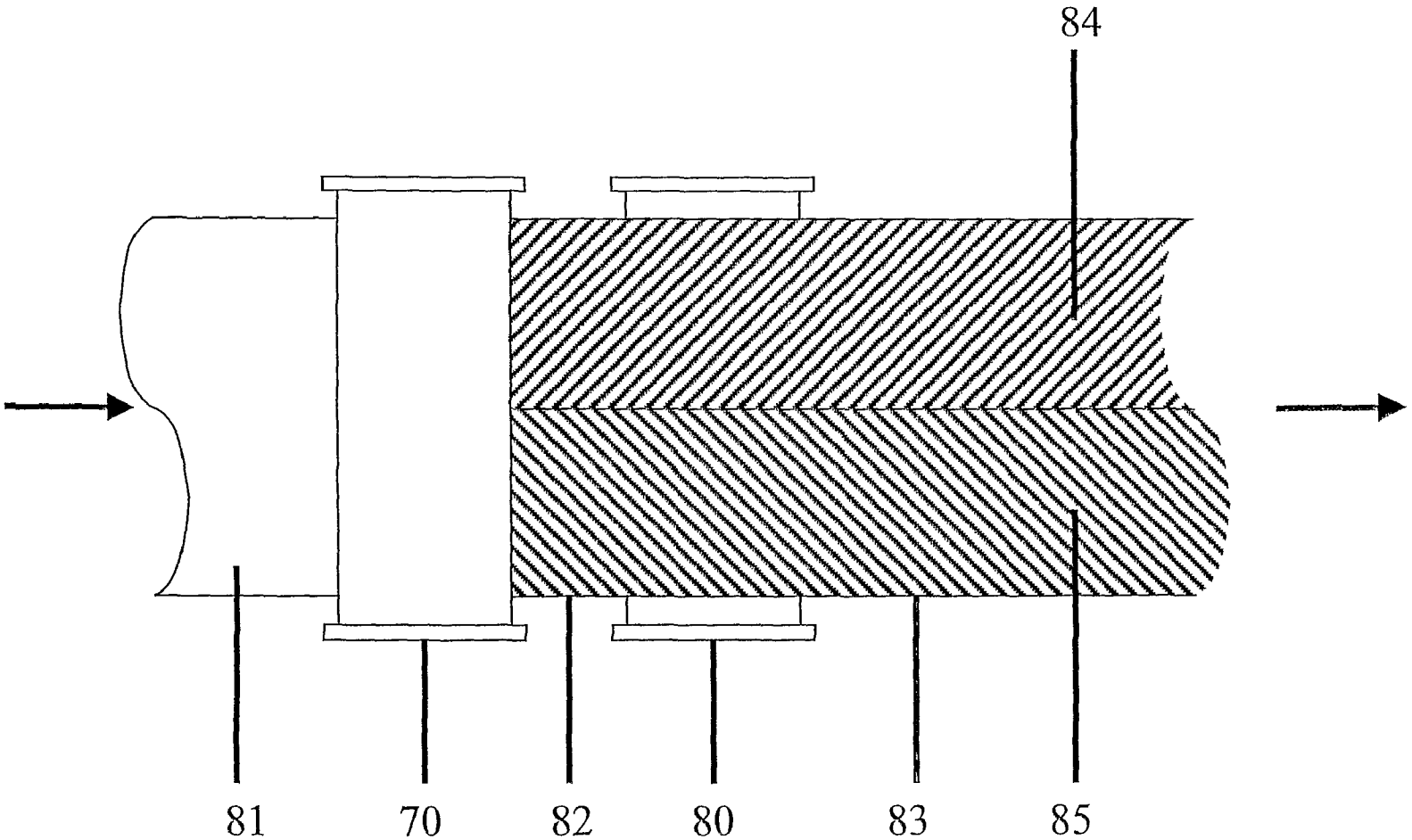
FIG. 9 is a plan view of a banded tow being treated with two additives.

FIG. 9 shows a plan view corresponding to FIG. 8. The untreated banded tow 81 passes against the applicators 70 and 80 to become the treated tow 83. The first applicator zones of the applicators 70 and 80 coat one half of the width of the tow with an acidic additive to give treated stripe 84. The second applicator zones of the applicators 70 and 80 coat the other half of the width of the tow with an alkaline additive to give treated stripe 85.

Figure 10:
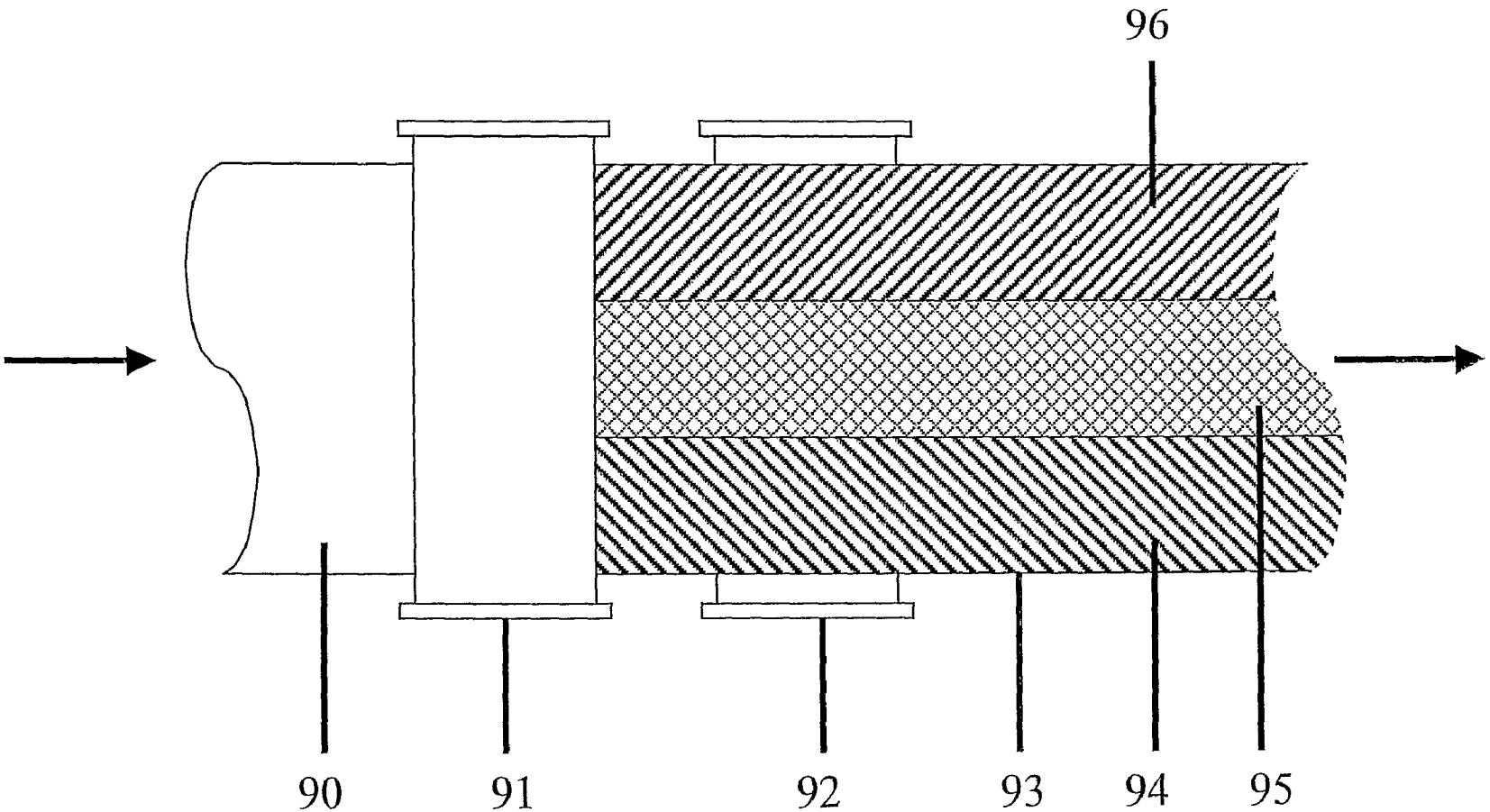
FIG. 10 is a plan view of a banded tow being treated with three additives.

The present invention also envisages the use of similar applicators to apply more than two additives to a banded tow. This could result in a banded tow having, for example, 3, 4 or 5 different types of additives across the width of the tow. FIG. 10 shows an example of this aspect of the invention. A banded tow 90 passes through a pair of applicators 91 and 92, which each have three applicators zones. As the tow 90 passes against the applicators 91 and 92, three different types of additives are applies to each face of the tow, giving a treated tow 93. The treated tow 93 has a first outer strip 94 of acidic material, a central strip 95 of particulate material, and a second outer strip 96 of alkaline material.

Thus, incompatible additives may be applied to the banded tow whilst being kept relatively isolated from other components. The treated banded tow may then be used in a conventional rod maker to produce filter rods having a mixture of different filaments with different additives thereon. The treated filter rod may then selectively reduce the presence of different types of components of main-stream-cigarette smoke.

It is also possible to minimise any unwanted interaction between different additives that are applied to the same tow of filaments by applying a barrier material between them. For example, a modified applicator may be used to apply a thin (e.g. 1 to 2 mm) strip of white oil between stripes of incompatible additives, such as an acidic compound and a basic compound, to prevent the additives from mixing together.

The concept of applying more than one additive is also applicable to other stages of the tow manufacture process. For example, different additives may be introduced to filaments during or after the spinning step but before being banded together. Thus, one set of spinning cells may produce filaments which incorporate acidic additive, sprayed thereon. A second set of spinning cells may produce filaments which incorporate an alkaline additive. The treated gathered arrays of filaments may be subsequently banded together to form the banded tow. This has the benefit that differently treated filaments may be more homogeneously distributed across the banded tow and in the resulting filter rod.

Figure 11:
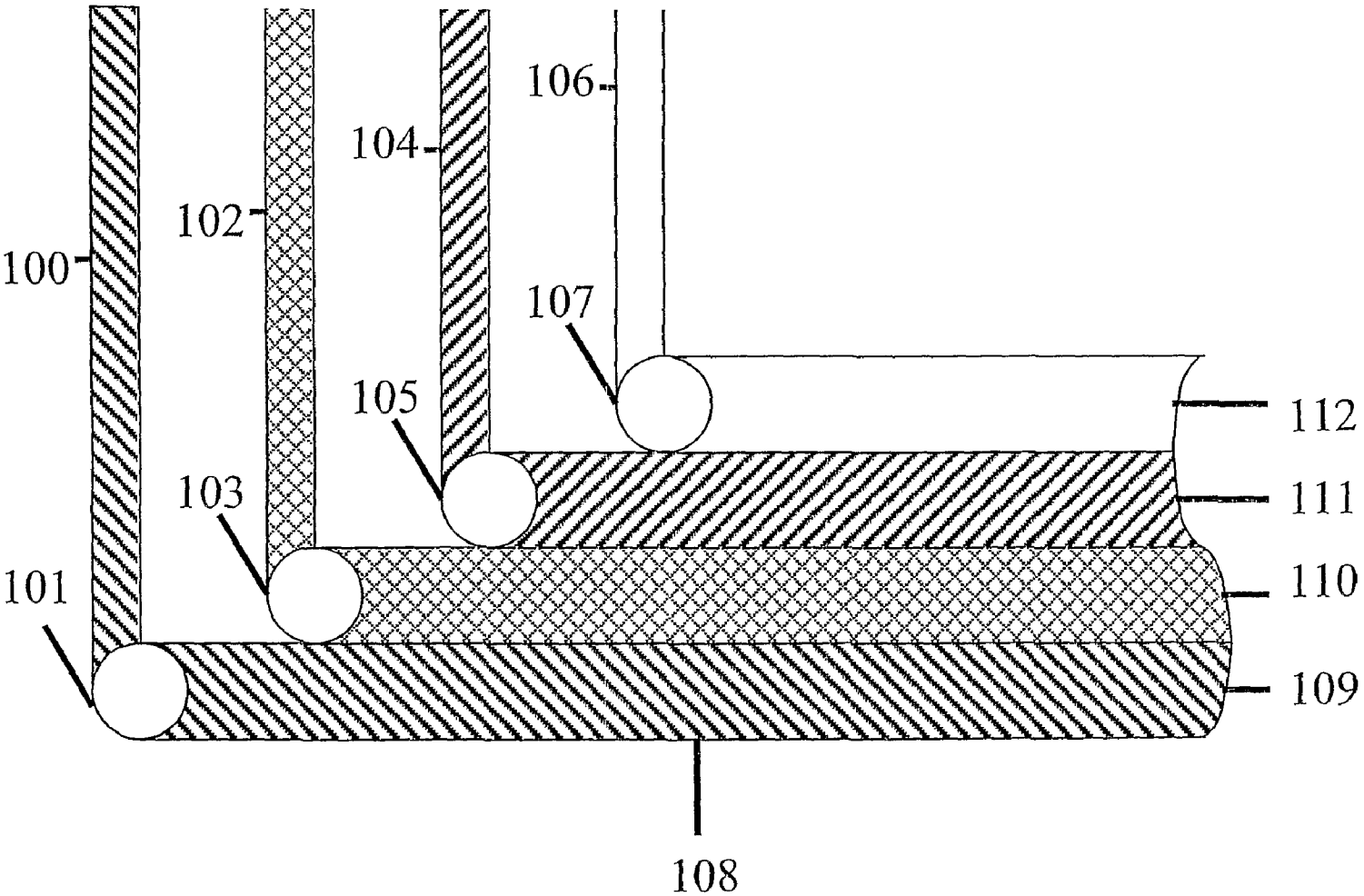
FIG. 11 is a plan view of four arrays of treated filaments being banded together to form a banded tow.

FIG. 11 shows the output from four different spinning cells being banded together to form a banded tow. As mentioned above, although the output from a large number of spinning cells would be banded together in practice, only four arrays of filaments are shown for clarity. A first array of filaments 100, incorporating an acidic additive, passes around a guide 101 to begin to form the banded tow. A second array of filaments 102, incorporating an adsorbent particulate additive, passes around a guide 103 to join the growing banded tow. A third array of filaments 104, incorporating an alkaline additive, passes around a guide 105 to join the banded tow. Finally, a fourth array of filaments 106, which does not incorporate an additional additive, passes around a guide 107 to complete the banded tow 108. The compete banded tow 108 thus comprises four stripes of filaments 109, 110, 111 and 112, each incorporating a different, or no, additive.

In practice, large numbers of arrays of filaments are arranged in overlapping arrangement to form banded tows, which could lead to more homogenous distribution of treated filaments in the complete treated banded tow and in the resulting filter rod.

Another aspect of the present invention concerns the combination of additives at different stages in the manufacturing process. In particular, it is possible to include one or more additives into the cellulose acetate dope itself. The additive-containing dope may then be used to form filaments which are treated with one or more further additives in accordance with the invention. For example, a compound such as sodium sulphamate may be dissolved in the dope and used to form filaments. The sodium sulphamate-containing filaments may then be treated with a dispersion of carbon powder before being crimped and formed into a bale. Numerous other combination of treatments are possible. Thus, the terms "cellulose acetate dope" or "dope" as used herein encompass a solution of cellulose acetate which includes one or more additives.

It is also to be appreciated that the different aspects of the present invention may be used in combination with themselves or with known techniques in the art. For example, the present invention may produce treated crimped tow which may then be used in a rod maker which incorporates particulate material. In this way a cigarette filter rod may be produced having enhanced functionality and the ability to selectively reduce different components of cigarette smoke.

Also, different aspects of the present invention may be used in combination with each other. For example a first additive may be incorporated as an aerosol of particulates blown into the drying chamber following spinning of an array of filaments. The resulting tow of filaments may then be treated by the application of an emulsion of a different additive at a downstream step.

Another aspect of the invention concerns the formation of a filter rod which contains a number of different additives. In particular, a filter rod may be formed by combining a number of filter rod segments together to form the final filter rod. For example, three filter rod segments each having a length of 10 mm may be joined together to form a complete filter rod having a length of 30 mm. Each of the filter rod segments may be made in accordance with the present invention and so contain different additives. The first segment may comprises filaments treated with an acidic compound, the second segment may comprise filaments treated with a basic compound and the third segment may comprises filaments treated with sodium sulphamate. In this way, the complete filter rod may remove basic compounds (first segment), acidic compounds (second segment) and formaldehyde (third segment), whilst keeping incompatible additives separate. This has the advantage that a filter rod having enhanced functionality may be readily prepared from separately prepared bales of tow, each being treated with different additives. This aspect of the invention encompasses a wide range of possible variations and combination of additives.

Other possible combinations of features may be apparent to a person skilled in the art. The present invention will now be exemplified with reference to the following experimental data. All the reagents and additives are commercially available and are used without additional purification, unless otherwise indicated.

EXAMPLES

The examples below illustrate the application of liquids, solutions, emulsions and dispersions (comprising particles preferably having <100 $m^2/g$ surface area) at various points in the tow manufacturing process to yield crimped tow product that contains additives. The bales of tows containing the additives were converted into filter rods using a standard Hauni KDF3/AF3 rodmaler. The resultant filter rods containing the treated tow have the effect of reducing the levels of selected components, such as Hoffmann analytes, in main-stream cigarette smoke.

Example 1

The Application of a Solution of DL-Malic Acid to the Towband Before Crimping The application system consisted of a pressurised tank, (10 psi), containing a 50% aqueous solution of malic acid that supplied the inlet to a metering gear pump. The output from this pump was split into two separate streams with each outlet conduit feeding an applicator over which a tow comprising 3 denier filaments having a "Y-shaped" cross-section and 11,677 filaments in total (known as 3Y/35,000) with an oil level of ~0.3% ran prior to crimping. The conduits to each applicator were of equal length and internal bore to ensure equal flow to each applicator. The applicators consisted of a plenum chamber and a series of eleven or twelve 1 mm diameter holes through which the pumped 50% malic acid solution was uniformly applied to the uncrimped towband about 1 m before the crimper. The applicators were placed so that the positions of the holes relative to the towband were offset to ensure an uniform application to the towband with eleven apertures on one side and twelve apertures on the other side of the tow. The application process of the malic acid solution was performed after the towband had been assembled from the individual spinning ends, but prior to the crimping process.

The crimping process comprised a pair of driven rollers that drive the tow into a box. The box, well known as a stuffer box, had a hinged top knife. The rollers were forced together by a hydraulic ram. The pressure on this ram, (the roller pressure), was about 7 psi. The pump speed was adjusted until a slight excess of solution was observed to be dripping from the crimper. The individual filaments buckled and formed a stable crimped towband. The resultant crimped towband was dried, stretched as required in order to partially loosen the towband and plaited into a box in order to form a bale.

The malic acid loading on the tow in the bale was determined by measuring the linear density, (the total denier), of the tow and comparing with a control with no acid applied. The level of malic acid on the tow was found to be 16% by weight.

Figure 12:
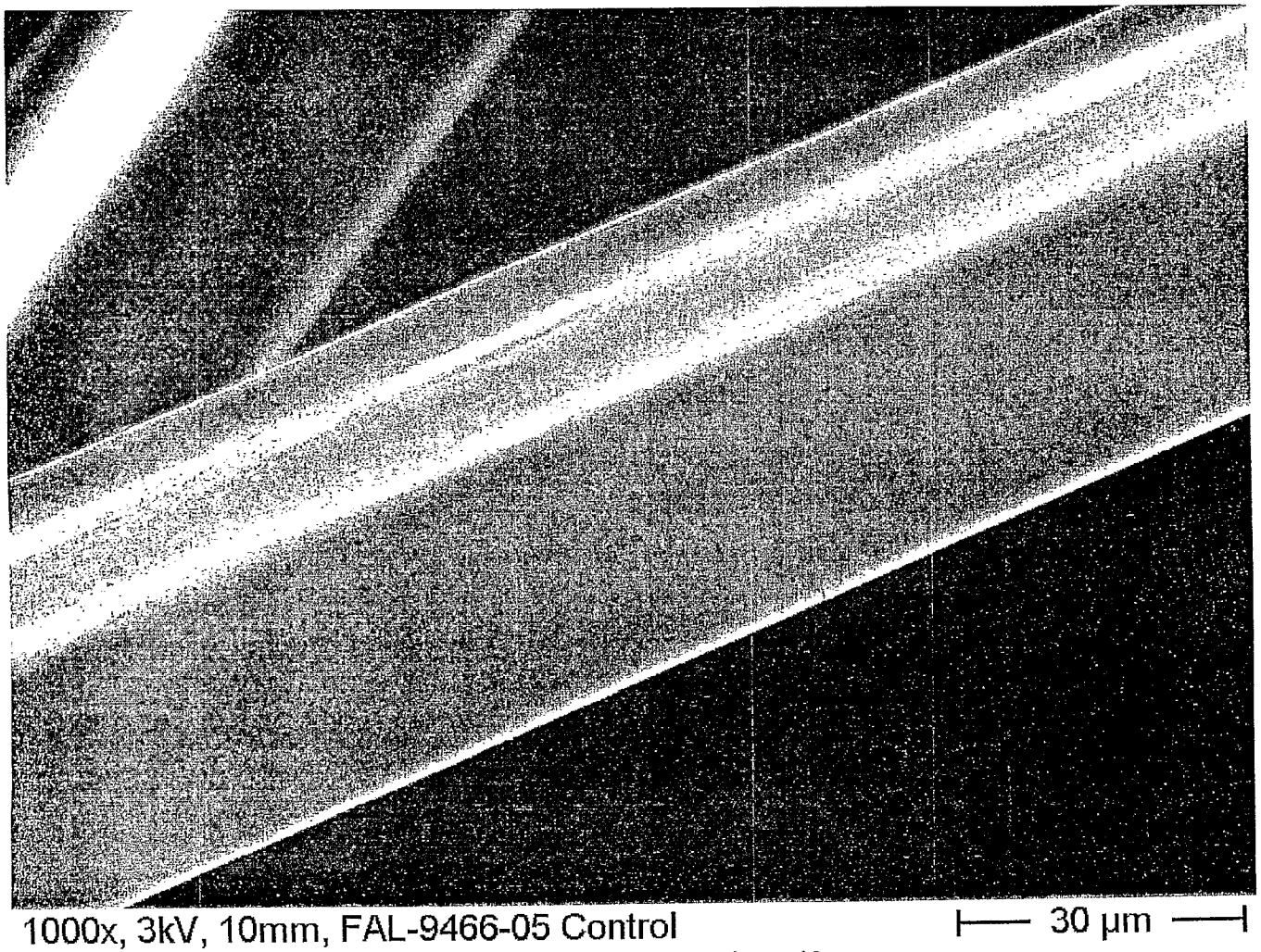
FIG. 12 is a scanning electron micrograph of a control filament without an additive at 1000× magnification.

The distribution of the malic acid on the treated filament was investigated using a scanning electron microscope. For comparison, an untreated control filament was also investigated and the resulting electron micrograph is shown in FIG. 12 (1000× magnification, 3 kV, 10 mm). The control filament was prepared according to the method of Example 1 except that malic acid solution was not applied to the filaments.

Figure 13:
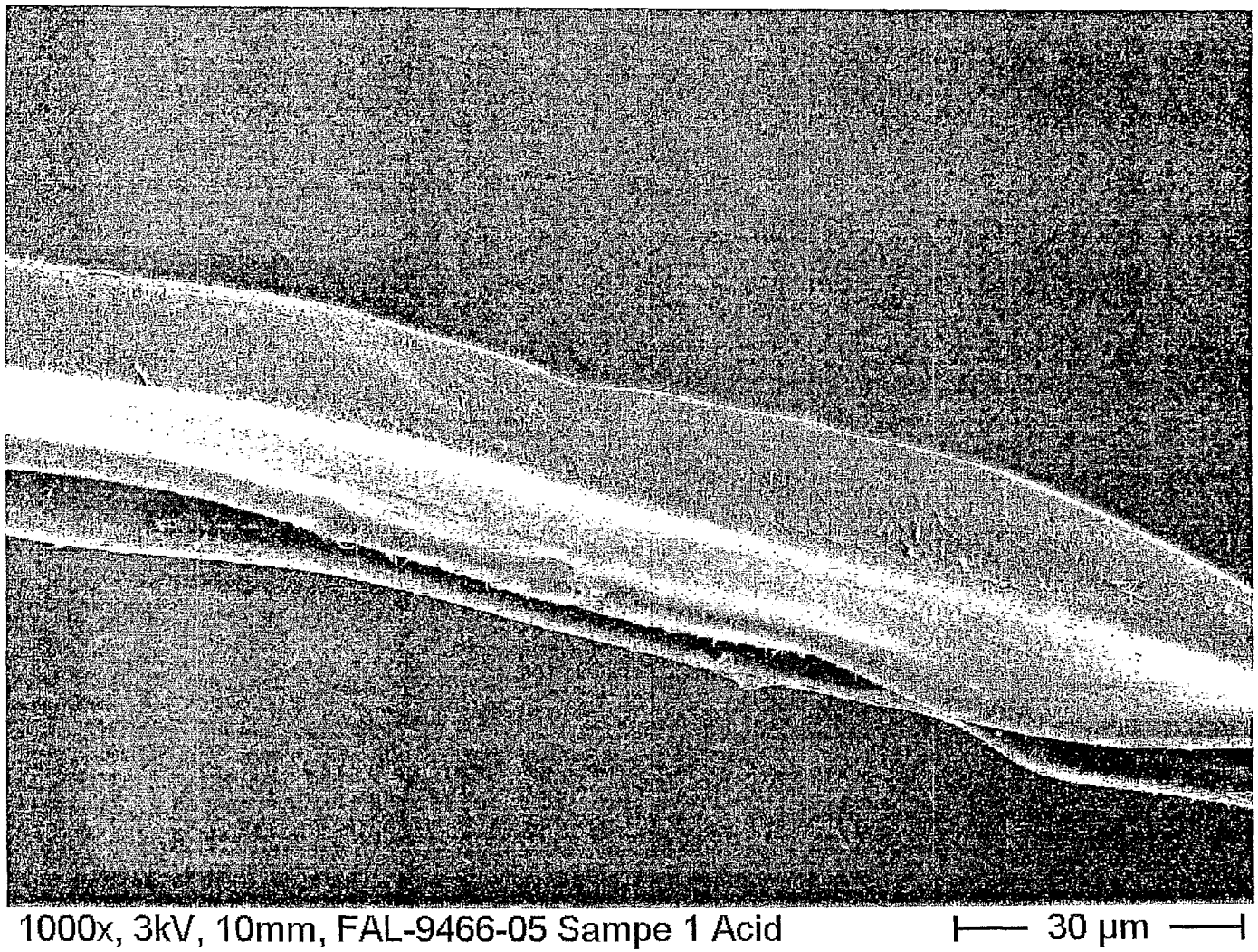
FIG. 13 is a scanning electron micrograph of a filament treated with malic acid at 1000× magnification.

FIG. 13 shows an electron micrograph for a filament prepared by the method of Example 1 (1000× magnification, 3 kV, 10 mm). It can be seen that the malic acid has formed a relatively smooth thin smeared layer over the surface of the filament.

Figure 14:
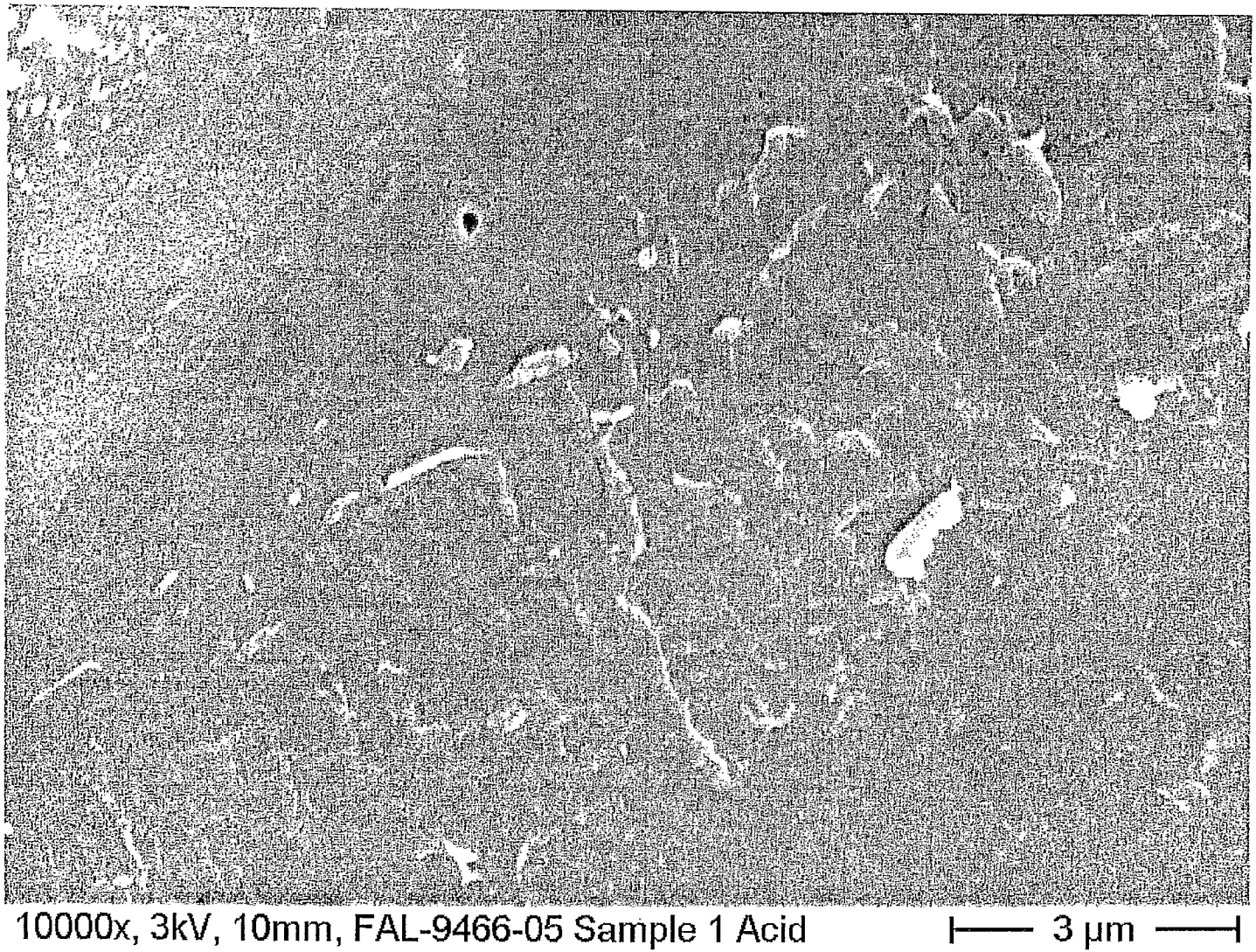
FIG. 14 is a scanning electron micrograph of the treated filament shown in FIG. 13 but at 10000× magnification.

FIG. 14 shows the treated filament in more detail (10000× magnification, 3 kV, 10 mm). Again, at this greater magnification it can be seen that the malic acid has formed a relatively smooth layer over the surface of the filament.

A bale of the tow treated with malic acid was processed into filter rods using a standard Hauni KDF3/AF3 rod maker. A gravimetric analysis comparing the tow and rods indicated that there was surprisingly no significant loss of malic acid during the rod making process. The rods were cut into 20 mm tips and attached to tobacco columns to produce cigarettes. A smoking analysis was carried out on these cigarettes, specifically evaluating the level of the compounds pyridine and quinoline in mainstream smoke. Quinoline and pyridine form part of the Hoffmann analyte list.

The results in Table 1 below compare the malic acid tow/filters with standard 3Y/35,000 acetate tow/filters with no additive applied.

TABLE 1

| Parameter | Sample | Control |
|---|---|---|
| Additive | DL-malic acid (16% by weight) | None |
| Rod Diameter | 7.73 | 7.72 |
| 20 mm Tip PD mm | 88 | 88 |
| Retention % TR | 53.5 | 49.9 |
| Retention % NR | 49.1 | 47.2 |
| Tar mg/cigarette | 8.4 | 8.4 |
| Nicotine mg/cigarette | 0.66 | 0.66 |
| CO mg/cigarette | 12.4 | 11.3 |
| Pyridine μg/cigarette | <0.2 | 10.2 |
| Quinoline μg/cigarette | 0.07 | 0.26 |

The abbreviation PD stands for pressure drop and is representative of the resistance to air flow through the filter. It is traditionally measured in mm of water in this technical field. The PD was measured using the method of a QTM, Filtrona rod tester well known in the field. TR and NR stand for tar retention and nicotine retention by the filter and were measured by standard methods well known in the field.

The results show that the volatile basic materials pyridine and quinoline were significantly reduced, by the amounts of 93% and 73% respectively in the main-stream smoke.

Example 2

The Application of a Solution of Potassium Carbonate to the Towband Before Crimping Using Glycerol as a Shed Suppressor In order to reduce loss of potassium carbonate when producing filter rods it was beneficial to use glycerol as a liquid shed suppressor.

The application system consisted of a pressurised tank (10 psi) containing a 50% aqueous solution of potassium carbonate and 10% glycerol that supplied the inlet to a metering gear pump. The output from this pump was split into two streams with each outlet conduit feeding an applicator over which a 3Y/35,000 low oil (~0.3% oil) tow ran prior to crimping. It was found to be advantageous to reduce the oil level of the tow from typical values of 0.8 to 1.4% in order to enable better adhesion of the additive. The conduits to each applicator were of equal length and internal bore to ensure equal flow to each applicator. The applicators consisted of a plenum chamber and a series of eleven or twelve 1 mm diameter holes through which the pumped 50% potassium carbonate solution was uniformly applied to the uncrimped tow band about 1 m before the crimper. The applicators were placed so that the positions of the holes relative to the towband were offset to ensure an uniform application to the towband. The application process of the potassium carbonate solution was performed after the towband had been assembled from the individual spinning ends, but prior to the crimping process.

The crimping process comprised a pair of driven rollers that drive the tow into a box. The box (also known as a stuffer box) had a hinged top knife. The rollers were forced together by a hydraulic ram. The pressure on this ram (the roller pressure) was 7 psi. The pump speed was adjusted until a slight excess of solution was observed to be dripping from the crimper. The individual filaments buckled and formed a stable crimped towband. The resultant crimped towband was dried, stretched as required in order to partially loosen the towband plaited into a box in order to form a bale.

The potassium carbonate loading on the tow in the bale was determined by measuring the linear density (the total denier) of the tow and comparing with a control tow with nothing applied. The level of potassium carbonate on the tow was found to be 8% by weight.

A bale of the tow treated with potassium carbonate tow was processed into filter rods using a standard Hauni KDF3/AF3 rod maker. A gravimetric analysis comparing the tow and rods indicated that there was surprisingly no significant loss of potassium carbonate during the rod making process. The rods were cut into 20 mm tips and attached to tobacco columns to produce cigarettes. A smoking analysis was carried out on these cigarettes, specifically evaluating the level of the compounds hydrogen cyanide and phenol in mainstream smoke. Hydrogen cyanide and phenol form part of the Hoffmann analyte list.

The results in Table 2 below compare the potassium carbonate tow/filters with standard 3Y/35,000 acetate tow/filters with no additive applied.

TABLE 2

| Parameter | Sample | Control |
|---|---|---|
| Additive | Potassium carbonate/glycerol. (8% potassium carbonate) | None |
| Rod Diameter | 7.72 | 7.72 |
| Rod PD mm | 514 | 516 |
| 20 mm Tip PD mm | 91 | 88 |
| Retention % TR | 51.9 | 49.9 |
| Retention % NR | 38.4 | 47.2 |
| Tar mg/cigarette | 8.4 | 8.4 |
| Nicotine mg/cigarette | 0.80 | 0.66 |
| CO mg/cigarette | 11.9 | 11.3 |
| Phenol μg/cigarette | 12.6 | 14.6 |
| Hydrogen cyanide μg/cigarette | 63 | 124 |

The results show that the volatile acidic materials hydrogen cyanide and phenol were significantly reduced by 49% and 14% respectively from mainstream cigarette smoke.

Example 3

The Application of a Solution of Potassium Carbonate to the Towband Before Crimping Using Polyacrylic Acid as an Adhesive In order to reduce loss of potassium carbonate when producing filter rods it was beneficial in this example to use polyacrylic acid as an adhesive shed suppressor. The application system consisted of a pressurised tank (10 psi) containing a 50% aqueous solution of potassium carbonate and 1% polyacrylic acid that supplied the inlet to a metering gear pump. The output from this pump was split into two streams with each outlet conduit feeding an applicator over which a 3Y/35,000 low oil (~0.3% oil) tow ran prior to crimping. The conduits to each applicator were of equal length and internal bore to ensure equal flow to each applicator. The applicators consisted of a plenum chamber and a series of eleven or twelve 1 mm diameter holes through which the pumped the solution was uniformly applied to the uncrimped tow band about 1 m before the crimper. The applicators were placed so that the positions of the holes relative to the towband were offset to ensure an uniform application to the towband. The application process of the solution was performed after the towband had been assembled from the individual spinning ends, but prior to the crimping process.

The crimping process comprised a pair of driven rollers that drive the tow into a box. The box (also known as a stuffer box) had a hinged top knife. The rollers were forced together by a hydraulic ram. The pressure on this ram, (the roller pressure), was 7 psi. The pump speed was adjusted until a slight excess of solution was observed to be dripping from the crimper. The individual filaments buckled and formed a stable crimped towband. The resultant crimped towband was dried, stretched as required in order to partially loosen the towband and plaited into a box in order to form a bale.

The potassium carbonate loading on the tow in the bale was determined by measuring the linear density (the total denier) of the tow and comparing with a control tow with nothing applied. The level of potassium carbonate on the tow was found to be 8% by weight.

A bale of tow treated with potassium carbonate was processed into filter rods using a standard Hauni KDF3/AF3 rod maker. A gravimetric analysis comparing the tow and rods indicated that there was surprisingly no significant loss of potassium carbonate during the rod making process. The rods were cut into 20 mm tips and attached to tobacco columns to produce cigarettes. A smoking analysis was carried out on these cigarettes, specifically evaluating the level of the acidic compounds hydrogen cyanide and phenol in mainstream smoke. Hydrogen cyanide and phenol form part of the Hoffmann analyte list.

The results in Table 3 below compare the potassium carbonate tow/filters with standard 3Y/35,000 acetate tow/filters with no additive applied.

TABLE 3

| Parameter | Sample | Control |
|---|---|---|
| Additive | Potassium carbonate/polyacrylic acid (8% by weight) | None |
| Rod Diameter mm | 7.73 | 7.72 |
| Rod PD mm | 498 | 516 |
| 20 mm Tip PD mm | 91 | 88 |
| Retention % TR | 47.5 | 49.9 |
| Retention % NR | 39.2 | 47.2 |
| Tar mg/cigarette | 8.3 | 8.4 |
| Nicotine mg/cigarette | 0.80 | 0.66 |
| CO mg/cigarette | 11.7 | 11.3 |
| Phenol μg/cigarette | 11.4 | 14.6 |
| Hydrogen cyanide μg/cigarette | 58 | 124 |

The results show that the volatile acidic materials hydrogen cyanide and phenol were significantly reduced by 53% and 11% respectively from mainstream cigarette smoke.

Example 4

The Application of Various Solutions of Acids to the Towband Before Crimping

Following the work of Example 1, a range of other acids were investigated. These included citric, L-tartaric, lactic (a liquid at room temperature) and ascorbic acids. In each case an aqueous solution was made up and placed in the pressurised tank previously described. The roller nip pressure was set to 6 psi and the loadings on the tow determined by a gravimetric method. The results are shown in Table 4 below.

TABLE 4

| | Citric acid | L-Tartaric acid | Lactic acid | Ascorbic acid |
|---|---|---|---|---|
| Solution Conc (%) | 50 | 50 | 50 | 17 |
| Level of acid on tow (% by weight) | 9.2 | 11.8 | 5.7 | 3.8 |

This work demonstrates the flexibility of this invention to apply a range of solutions, in this example acids, to the uncrimped towband and surprisingly produce a satisfactory crimped towband with satisfactory tow opening and tow strength properties.

Example 5

The Application of Poly(Ethyleneimine) (PEI) Solution to the Towband Before Crimping A sample of a branched poly(ethyleneimine) (Mn 60,000, Mw 750,000) was obtained from Sigma Aldrich as a 50% aqueous solution. 25 and 35% solutions of the PEI were made up and applied to the tow using the method of Example 1. Surprisingly a satisfactory tow was produced. The loading of PEI on tow using a crimper roller pressure of 6 psi is shown in Table 5 below.

TABLE 5

| | Solution Conc (%) | |
|---|---|---|
| | 25% solution | 35% solution |
| Loading (% by weight) | 6.5 | 8.4 |

A bale of this tow was processed into filter rods using a standard Hauni KDF3/AF3 opener and rod maker. There was minimal loss of the additive on processing.

This tow is expected to reduce the level of Formaldehyde in mainstream smoke. Formaldehyde is on the Hoffmann analyte list.

Example 6

The Application of Cyclodextrin Solution to the Towband Before Crimping

A sample of Cavasol W7 M (a methylated cyclodextrin from Wacker Chemie) was made into a 25% aqueous solution and applied to the uncrimped tow using the method of Example 1. It was desirable to use the derivatised cyclodextrins in order to make use of the increased solubility as this leads to higher potential loadings on the tow. Surprisingly a satisfactory tow was produced. The resultant loadings on the tow are given below. The loading of the methylated cyclodextrin on tow using a crimper roller pressure of 6 psi is shown in Table 6 below.

TABLE 6

| Roller Pressure (psi) | Loading on tow (% by weight) |
|---|---|
| 6 | 6.5 |

A bale of the material was processed into filter rods using a standard Hauni KDF3/AF3 opener and rod maker. There was minimal loss of the additive on processing.

It is believed this tow has the potential to reduce the level of small organic aromatic molecules in main-stream smoke.

Example 7

The Application of Sodium Sulphamate Solution to the Towband Before Crimping

A 40% aqueous solution of sodium sulphamate was produced by carefully adding an equimolar amount of sodium hydroxide to a solution of sulphamic acid. The solution was applied to the uncrimped tow using the method of Example 1. Surprisingly a satisfactory tow was produced. The loading of Sodium Sulphamate on tow using a crimper roller pressure of 6 psi is shown in Table 7 below.

TABLE 7

| Roller Pressure (psi) | Loading on Tow (% by weight) |
|---|---|
| 6 | 5.9 |

The addition of sodium sulphamate is expected to remove or reduce formaldehyde in main-stream smoke Example 8

The Spraying of a Calcium Carbonate Dispersion onto Filaments in the Spinning Cell The spinning cell used consisted of a 30 cm square, 5 m long rectangular chamber through which air at about 100° C. was forced in a direction counter to that of the filament extrusion. At the top of the spinning cell dope was fed to a spinneret. This jet had 200 triangular holes. The side of each triangle was 56 μm in length. A spinning dope was extruded through the spinneret holes. The dope concentration was 26% cellulose acetate in a solvent comprising 97% acetone 3% water. The dope extrusion rate was adjusted to give a filament denier per filament (dpf) of 3.

A 30% aqueous dispersion of finely divided calcium carbonate powder (70%<1-2 μm, 97%<5 μm supplied by Longcliffe) having a surface area of <5 $m^2/g$ was placed in a bottle equipped with an aerosol fitting. The vessel was connected to a compressed air supply and the dispersion was sprayed onto the cellulose diacetate filaments in the first part of the extrusion zone. Typically this was within a distance of 15 cm from the face of the spinneret. Surprisingly the spinning stability was not affected and the particles were attached to the nascent filaments. A loading of 1.5% by weight of calcium carbonate was applied to the filaments.

This work demonstrates the potential for applying particles that preferably have a surface area less than 100 $m^2/g$ that are potentially capable of reducing substances in mainstream smoke that are on the Hoffmann analyte list.

Example 9

The Addition of a Carboxylated Acrylic Emulsions to Fibres Exiting the Spinning Cell A carboxylated acrylate emulsion (Glascol C20 supplied by Ciba Specialities as a 46% polymer in water emulsion) was added as a 20% solids emulsion below the spinning cell but prior to spin finish application via an MSA system.

A satisfactory fibre was produced. This work demonstrates the potential for adding emulsions to the fibre that are potentially capable of reducing substances in main-stream smoke that are on the Hoffmann analyte list.

Example 10

The Application of Two Different Additives to the Towband Before Crimping—Citric Acid and Potassium Carbonate Following the work principles of Example 1, two different aqueous solutions were applied to the towband, namely citric acid and potassium carbonate/glycerol. In each case an aqueous solution was made up and placed in two separate pressurised tanks previously described. Each tank was connected to a separate pump that pumped the solution to an applicator. In this example the applicator had a plate that divided the plenum chamber into two. One solution was fed to one side of the applicator the other solution to the other side. This resulted in one half of the towband being treated with citric acid solution and the other half of the towband being treated with potassium carbonate solution. The feed rate of the solutions was carefully regulated in order to ensure no excess solutions were being applied in order to reduce any potential for the solutions to mix together. Surprisingly a satisfactory towband was produced with good opening and strength properties. There was only a small amount of mixing of the two solutions at the centre of the towband. The roller nip pressure was 6 psi and the total loading on the tow was determined to be 15% by weight by a gravimetric method This work demonstrates one method of applying two different additives to the towband before crimping with each additive capable of reducing different classes of compounds in mainstream smoke that are on the Hoffmann analyte list e.g. in the example described here, both basic and acidic compounds can be reduced.

Example 11

Combination of Application Methods to Apply Multiple Additives

This example illustrates the potential to combine the addition methods described above in order to get a combined effect.

The method of example 8 is used to apply a loading of calcium carbonate to the filaments in the cell. In addition the method of example 6 is used to apply a cyclodextrin solution to the already treated filaments. This gives a resulting tow that possesses the functionality of both species.

The invention claimed is:

1. A method of preparing a crimped tow of cellulose acetate filaments comprising the steps of:

a) providing cellulose acetate dope;

b) forming filaments from the dope;

c) applying at least one acidic additive and one alkaline additive to a surface of the filaments, the at least one acidic additive and one alkaline additive being capable of removing a component from cigarette smoke; and, thereafter, d) crimping the filaments to form a crimped tow.

2. A method according to claim 1 wherein the additives comprises a solution, emulsion, liquid, or particulate material or combinations thereof.

3. A method according to claim 1 wherein the at least one acidic and alkaline additives comprises malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate and carboxylated acrylate.

4. A method according to claim 1 wherein the additives further comprises particles of carbon, silica, zeolite, clay, alumina, metal, molecular sieves or an ion exchange resin.

5. A method according to claim 4 wherein the carbon comprises activated carbon.

6. A method according to claim 4 further comprising the step of steeping the particles in water before application to the filaments.

7. A method according to claim 5 wherein the particles comprise a material capable of generating a gaseous emission.

8. A method according to claim 7 wherein the material is a liquid which can volatilized to generate a gas or vapour by the action of heat and/or reduced pressure.

9. A method according to claim 7 wherein the material is water.

10. A method according to claim 1 wherein the additives being applied to the filaments using an adhesive.

11. A method according to claim 10 wherein the adhesive comprises a cellulose ether.

12. A method according to claim 10 wherein the adhesive comprises methyl cellulose.

13. A method according to claim 1 further comprising the step of applying a shed suppressor to the filaments.

14. A method according to claim 13 wherein the shed suppressor is glycerol.

15. A method according to claim 1 wherein the filaments have a non-circular cross-section.

16. A method according to claim 1 wherein the filaments have a multi-lobal cross-section.

17. A method according to claim 1 wherein the component is a Hoffmann analyte.

18. A method according to claim 17 wherein the component comprises hydrogen cyanide, formaldehyde, pyridine, quinoline or phenol.

19. A method according to claim 1 wherein the step of forming filaments from the dope comprises extruding the dope through a spinneret to form an array of filaments, and drying the filaments to remove a dope solvent.

20. A method according to claim 19 wherein at least one additive is applied to the filaments during the drying step.

21. A method according to claim 19 wherein at least one additive is applied to the filaments after the drying step.

22. A method according to claim 19 comprising the step of combining the filaments produced by a plurality of spinnerets to produce a banded tow of filaments.

23. A method according to claim 22 wherein at least one additive is applied to the filaments before formation of the banded tow.

24. A method according to claim 22 wherein at least one additive is applied to the filaments after formation of the banded tow.

25. A method according to claim 22 wherein at least one additive is applied to the filaments immediately before the step of crimping to form the crimped tow.

26. A method according to claim 1 wherein the additives comprises a plurality of additives.

27. A method according to claim 26 wherein the plurality of additives comprises three additives.

28. A method according to claim 26 wherein the plurality of additives are applied separately to the filaments.

29. A method according to claim 26 wherein the plurality of additives are applied concurrently to the filaments.

30. A method according to claim 26 wherein the plurality of additives are applied sequentially to the filaments.

31. A method according to claim 26 wherein each of the plurality of additives is incorporated into a substantially separate portion of the filaments.

32. A method according to claim 26 comprising the step of applying the plurality of additives to the banded tow in stripes.

33. A method according to claim 32 wherein the step of applying the plurality of additives to the banded tow in stripes further comprises the application of a barrier material between adjacent stripes.

34. A method according to claim 33 wherein the barrier material comprises white oil.

35. A method according to claim 26 wherein the step of forming filaments from the dope comprises extruding the dope through a spinneret to form an array of filaments, and drying the filaments to remove a dope solvent.

36. A method according to claim 35 wherein one of the plurality of additives is applied to the filaments during the drying step and another of the plurality of additives is applied to the filaments after the drying step.

37. A method according to claim 35 wherein one of the plurality of additives is applied to the filaments formed by a first spinnerette and another of the plurality of additives is applied to the filaments formed by a second spinnerette.

38. A method according to claim 1 wherein the step of providing cellulose acetate dope comprises incorporating at least one additive into the dope.

39. A method according to claim 1 further comprising the step of plaiting the crimped tow of filaments into a bale.

40. A method according to claim 1 further comprising the step of forming a filter rod from the crimped tow of filaments.

41. A method according to claim 40 wherein the step of forming a filter rod further comprises incorporating at least one additive into the filter rod.

42. A method according to claim 41 wherein a particulate additive is incorporated into the tow of filaments.

43. A method according to claim 41 wherein a particulate additive is incorporated into a cavity in the filter rod.

44. A method according to claim 40 wherein the step of forming a filter rod comprises combining a plurality of filter rod segments together to form the filter rod.

45. A method according to claim 44 wherein each of the plurality of filter rod segments comprises filaments that incorporate a different additive.

46. A method according to claim 44 wherein the filter rod comprises three filter rod segments.

47. A method according to claim 40 further comprising the step of forming a cigarette from the filter rod.

* * * * *